US006286515B1

(12) United States Patent
Wagoner

(10) Patent No.: US 6,286,515 B1
(45) Date of Patent: Sep. 11, 2001

(54) HUMIDIFICATION CYLINDER

(75) Inventor: Steven Rohn Wagoner, Midlothian, VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 09/505,886

(22) Filed: Feb. 17, 2000

(51) Int. Cl.[7] ..... A24B 3/02; D06F 58/00; F26B 11/02

(52) U.S. Cl. ..... 131/305; 131/300; 131/290; 131/306; 34/109; 34/128; 34/130; 34/138

(58) Field of Search ..... 131/305, 290, 131/300, 302, 304, 306; 34/108, 109, 127, 128, 130, 138; 366/54

(56) References Cited

U.S. PATENT DOCUMENTS

| | | | | |
|---|---|---|---|---|
| 4,202,357 | | 5/1980 | de la Burde et al. . | |
| 4,498,486 | | 2/1985 | Smith . | |
| 4,517,992 | * | 5/1985 | Korte et al. | 131/304 |
| 4,572,218 | | 2/1986 | Hine et al. . | |
| 4,583,559 | | 4/1986 | Hedge . | |
| 4,788,989 | | 12/1988 | Nambu et al. . | |
| 4,791,942 | | 12/1988 | Rickett et al. . | |
| 5,040,550 | | 8/1991 | Argyropoulos . | |
| 5,103,842 | | 4/1992 | Strang et al. . | |
| 5,117,844 | | 6/1992 | Spicer . | |
| 5,365,814 | | 11/1994 | Irikura . | |
| 5,383,479 | | 1/1995 | Winterson et al . | |
| 5,425,384 | | 6/1995 | White . | |
| 5,526,581 | | 6/1996 | Winterson et al. . | |
| 5,755,238 | | 5/1998 | Soots et al. . | |

* cited by examiner

*Primary Examiner*—James Derrington
*Assistant Examiner*—Dionne A. Walls
(74) *Attorney, Agent, or Firm*—Burns, Doane, Swecker & Mathis, LLP

(57) ABSTRACT

A humidifying cylinder includes a first rotatable cylinder having an inlet end and an outlet end and a plurality of first blades extending substantially radially outwardly from an exterior surface of the first cylinder. The humidifying cylinder further includes a second rotatable cylinder having an inlet end and an outlet end and a plurality of second blades extending substantially radially inwardly from an interior surface of the second cylinder, the second cylinder being substantially coaxial with the first cylinder and the first cylinder being disposed inside of the second cylinder such that the exterior surface of the first cylinder and the interior surface of the second cylinder define an annular space. At least one drive is provided for rotating the first cylinder and the second cylinder. At least one conduit is disposed in the annular space for introducing moisture into the annular space. A method of humidifying material is also disclosed.

11 Claims, 2 Drawing Sheets

HUMIDIFICATION CYLINDER

FIELD OF THE INVENTION

The present invention relates to a humidification or moisturization device and method, more particularly, to a device and a method for humidifying or moisturizing tobacco.

BACKGROUND AND SUMMARY

It is often necessary to humidify or moisten dry particulate materials prior to further use of the materials. For example, expanded tobacco is typically reordered by permitting the tobacco particles to reside in a humid atmosphere or by conveying the tobacco particles on a conveyor through a humid atmosphere for a necessary period of time. Unless the tobacco is moved about through the humid atmosphere, the residence time in the humid atmosphere can be prohibitively time consuming.

Equipment such as the rotary tobacco treatment cylinder disclosed in U.S. Pat. No. 5,425,384 can be used to rapidly reorder tobacco. One problem with such equipment is that, when the cylinder is too large, it tends to degrade the tobacco particles because the particles fall from blades on the interior of the cylinder to the bottom of the cylinder over a great distance. When the cylinder is made smaller, the capacity of the cylinder is reduced. It is desirable to provide a reordering device that permits rapid reordering of large quantities of tobacco while minimizing degradation of the tobacco.

In accordance with one aspect of the present invention, a humidifying cylinder includes a first rotatable cylinder having an inlet end and an outlet end and a plurality of first blades extending substantially radially outwardly from an exterior surface of the first cylinder. The humidifying cylinder further includes a second rotatable cylinder having an inlet end and an outlet end and a plurality of second blades extending substantially radially inwardly from an interior surface of the second cylinder, the second cylinder being substantially coaxial with the first cylinder and the first cylinder being disposed inside of the second cylinder such that the exterior surface of the first cylinder and the interior surface of the second cylinder define an annular space. At least one drive is provided for rotating the first cylinder and the second cylinder. At least one conduit is disposed in the annular space for introducing moisture into the annular space. A method of humidifying material is also disclosed.

In accordance with another aspect of the present invention, a method of humidifying material is disclosed. According to the method, material is introduced into an annular space between a first rotatable cylinder having an inlet end and an outlet end and a plurality of first blades extending substantially radially outwardly from an exterior surface of the first cylinder and a second rotatable cylinder having an inlet end and an outlet end and a plurality of second blades extending substantially radially inwardly from an interior surface of the second cylinder, the second cylinder being substantially coaxial with the first cylinder and the first cylinder being disposed inside of the second cylinder such that the exterior surface of the first cylinder and the interior surface of the second cylinder define the annular space. The first cylinder and the second cylinder are rotated such that, as the second cylinder is rotated, material falls from at least some of the second blades onto the first cylinder and, as the first cylinder rotates, material falls from at least some of the first blades onto the second cylinder. Material is conveyed in the annular space from the inlet end of the first cylinder and the inlet end of the second cylinder toward the outlet end of the first cylinder and the outlet end of the second cylinder. Moisture is applied to material in the annular space.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
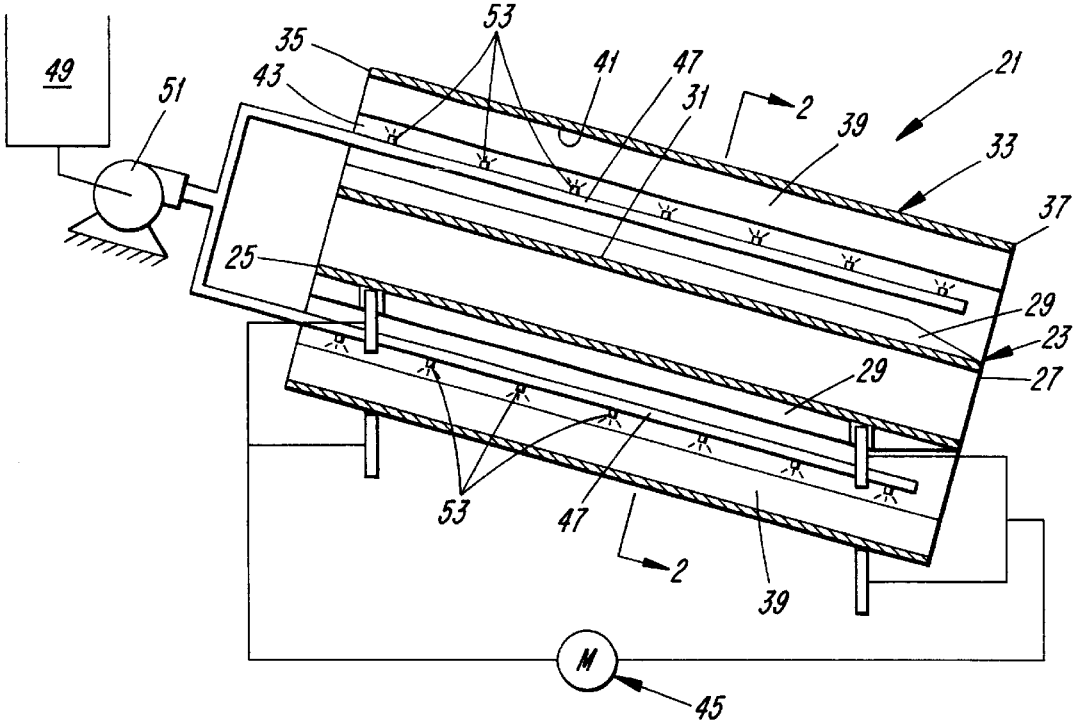
FIG. 1 is a schematic, cross-sectional side view of a humidifying cylinder according to an embodiment of the present invention.
Figure 2:
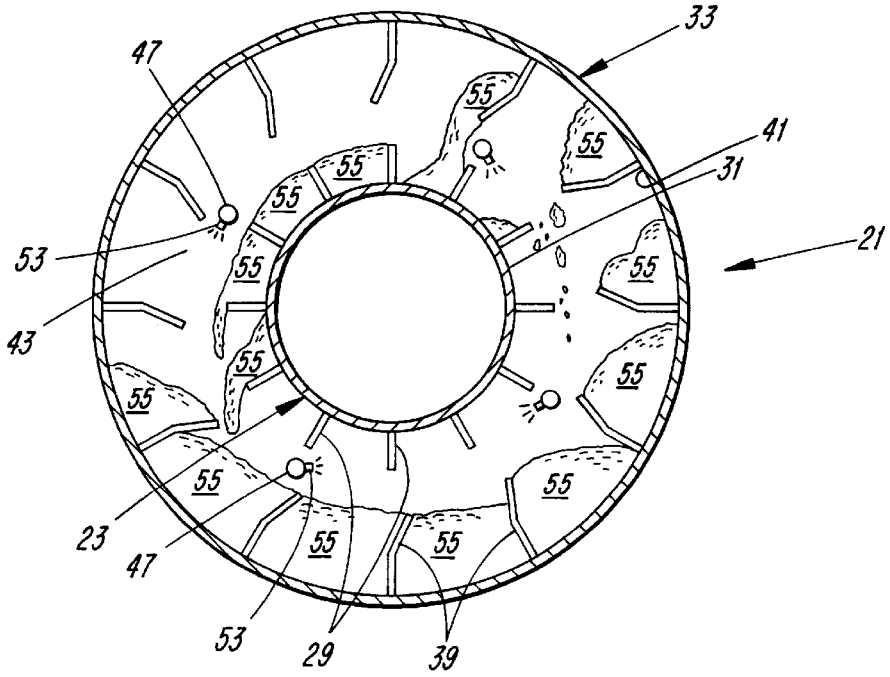
FIG. 2 is a schematic, cross-sectional view of the humidifying cylinder of FIG. 1 taken at Section 2—2.

A humidifying cylinder 21 according to an embodiment of the present invention is seen in FIG. 1 and FIG. 2, showing the humidifying cylinder in longitudinal cross-section and axial cross-section. For purposes of the present invention, the words humidification and moisturization will be used substantially interchangeably to convey the general notion of applying moisture to dry material, such as during reordering of tobacco. The cylinder 21 and method according to the present invention are preferably used to reorder tobacco, more preferably expanded tobacco, from 1% OV (oven volatiles) to 20% OV, although it is contemplated that the cylinder will be useful in increasing the moisture of a number of other different products, such as increasing moisture from bone dry to 50% moisture. For purposes of the present application, % moisture may be considered to be equivalent to oven volatiles (OV) as explained in U.S Pat. No. 4,202,357, which is incorporated by reference.

The humidifying cylinder 21 includes a first rotatable cylinder 23 having an inlet end 25 and an outlet end 27 and a plurality of first blades 29 extending substantially radially outwardly from an exterior surface 31 of the first cylinder. If desired or necessary, the first cylinder 23 may be in the form of a plurality of blades connected at an axis of the first cylinder, without providing an actual cylinder to which the blades are attached.

The humidification cylinder 21 further includes a second rotatable cylinder 33 having an inlet end 35 and an outlet end 37 and a plurality of second blades 39 extending substantially radially inwardly from an interior surface 41 of the second cylinder. The second cylinder 33 is preferably substantially coaxial with the first cylinder 23. The first cylinder 23 is disposed inside of the second cylinder 33 such that the exterior surface 31 of the first cylinder and the interior surface 41 of the second cylinder define an annular space 43.

Figure 3:
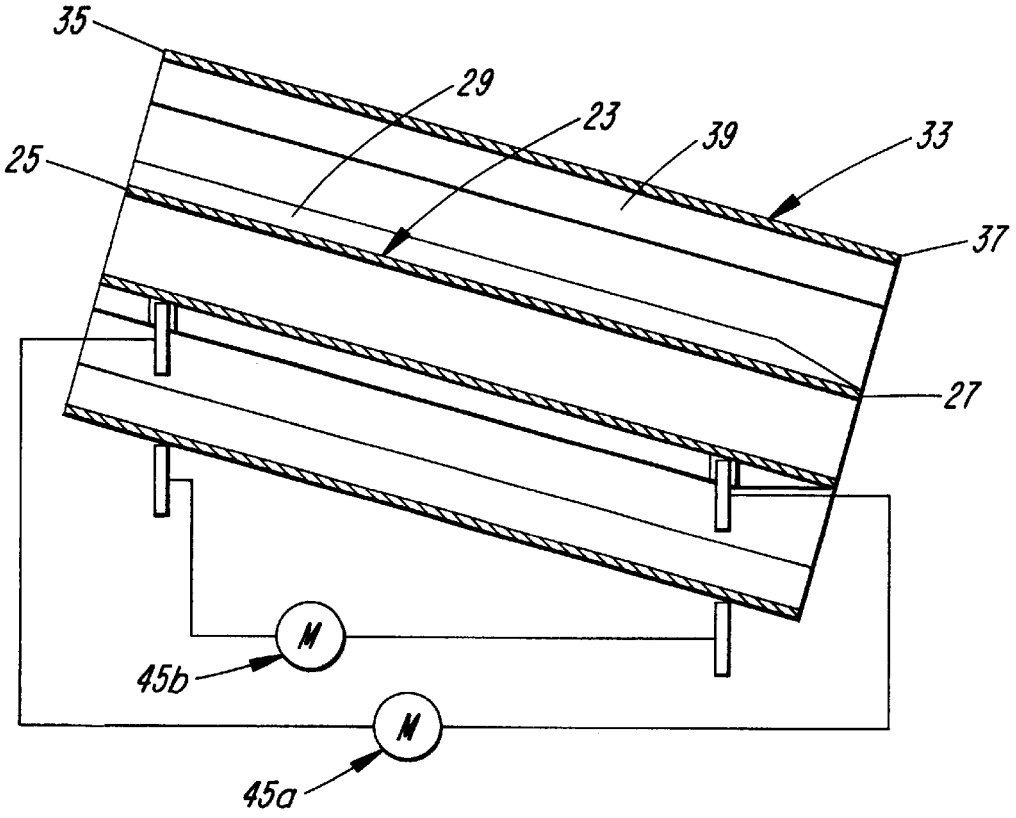
FIG. 3 is a schematic, cross-sectional side view of a humidifying cylinder according to another embodiment of the present invention.

At least one drive 45 is provided for rotating the first cylinder 23 and the second cylinder 33. Preferably, the drive 45 includes a single motor, such as an electric motor, arranged to drive both the first cylinder 23 and the second cylinder 33 using means such as gears, chains, belts, and the like. The first cylinder 23 and the second cylinder 33 can be rigidly connected to each other, such as by bars disposed at interior points of the cylinders, to facilitate driving the cylinders with a common drive, or may be driven by a common drive that drives rotatable supports, such as is disclosed in U.S. Pat. No. 5,425,384, which is incorporated by reference. If desired or necessary, as seen in FIG. 3, separate drives 45*a* and 45*b* can be provided for driving the first cylinder 23 and the second cylinder 33 (shown without other features shown in FIGS. 1 and 2 for sake of clarity). In all embodiments of the present invention, the first cylinder 23 and the second cylinder 33 are preferably driven in the same direction of rotation, however, if desired or necessary, the first cylinder and the second cylinder may be driven in opposite directions of rotation.

The humidification cylinder 21 includes at least one, preferably a plurality of conduits 47 disposed in the annular space 43 for introducing moisture into the annular space. The conduits 47 are preferably pipes connected to a source of moisture 49 such as water and a pump 51 for forcing the water through the conduits 47 under pressure. The conduits 47 preferably include a plurality of nozzles 53 arranged along their length so that, when moisture under pressure is pumped through the conduits, the moisture is introduced into the annular space 43 in the form of atomized droplets. If desired or necessary, the moisture may be introduced into the annular space 43 in the form of moisture streams or cascades, or by other means than through conduits in the annular space, such as through openings in the first or second cylinders. The moisture is preferably introduced at substantially ambient temperatures, however, if desired or necessary, the moisture may be introduced in the form of steam.

The conduit or conduits 47 may be provided with nozzles for introducing moisture in different amounts in different regions of the annular space 43. For example, the nozzles 53 may be larger toward the inlet ends of the cylinders 23 and 33 so that more or less moisture may be introduced at the inlet ends of the cylinders where material 55 is initially introduced than at other regions of the annular space, as desired or necessary for a particular application. When moisturizing expanded tobacco, it may be desirable to introduce more moisture at an inlet end of the humidifying cylinder 21 than elsewhere in the cylinder to minimize problems with degradation of the tobacco due to the rotation of the first and second cylinders 23 and 33. Instead of conduits that introduce moisture continuously over their length or at different points along the entire length of the annular space 43, conduits may introduce moisture at particular points or continuously or discontinuously over limited lengths of the annular space, and multiple conduits may be provided to introduce moisture at different rates over the length of the annular space, as desired or necessary.

The inlet end 25 of the first cylinder 23 and the inlet end 35 of the second cylinder 33 are preferably disposed vertically above the outlet end 27 of the first cylinder 23 and the outlet end 37 of the second cylinder 33, respectively. In this way, material 55 introduced into the annular space 43 at the inlet ends of the first cylinder 23 and the second cylinder 33 is conveyed toward the outlet ends of the cylinders under gravity and then, preferably, falls out of the annular space for further operations.

As seen in FIG. 2, some or all of the first blades 29 and some or all of the second blades 39 may be bent to optimize operational characteristics such as the angle of rotation of the blades relative to a horizontal plane at which material 55 cascades from the blades to a lower point in the annular space during rotation of the first and second cylinders 23 and 33. U.S. Pat. No. 5,425,384 discloses bending blades in a rotatable tobacco treatment cylinder to control the release of tobacco from blades on an interior surface of the cylinder and is incorporated by reference.

The first cylinder 23, the first blades 29, the second cylinder 33, and the second blades 39 are preferably sized such that, when the first cylinder and the second cylinder are rotated, material 55 falls from second blades onto the first cylinder and then falls from first blades onto the second cylinder. Preferably, all of the material 55 falling from the second blades 39 falls onto the first cylinder 23 before falling onto the second cylinder, however, it is anticipated that, in normal operation, some material will fall directly from the second blades 39 to a bottom point of the second cylinder without first falling onto the first cylinder and that, for some applications of the humidifying cylinder, this may be a desirable result. When reordering tobacco, it is presently believed that it will generally be desirable for all tobacco falling from the second blades 39 to first fall onto the first cylinder 23 and then, after further rotation of the first cylinder, to a lower level of the second cylinder. Thus, according to the present invention, problems with degradation of the tobacco are minimized by reducing the distance that the tobacco falls each time that it falls from the second blades 39, at least as compared to rotating cylinder humidification devices in which no first cylinder is provided.

It is presently preferred that the first and second cylinders 23 and 33 will each be about 15'–25' (4.57 m to 7.62 m) in length, that the first cylinder 23 will have an exterior diameter of about 1'–4' (0.30 m to 1.22 m), that the second cylinder 33 will have an interior diameter of about 3'–8' (0.91 m to 2.44 m).

A method of humidifying material 55 according to the present invention is described in connection with the cylinder 21 shown in FIGS. 1 and 2. According to the method, material 55 is introduced into the annular space 43 between the first rotatable cylinder 23 and the second rotatable cylinder 33. The first cylinder 23 and the second cylinder 33 are rotated such that, as the second cylinder is rotated, material 55 falls from at least some of the second blades 39, i.e., the blades that have rotated with the second cylinder toward an upper region of the second cylinder beyond a horizontal plane, onto the first cylinder and, as the first cylinder rotates, material falls from at least some of the first blades 29 back onto the second cylinder, i.e., a lower region of the second cylinder.

Material 55 in the annular space 43 is conveyed from the inlet end 25 of the first cylinder 23 and the inlet end 35 of the second cylinder 33 toward the outlet end 27 of the first cylinder and the outlet end 37 of the second cylinder by gravity by arranging the inlet ends of the first and second cylinders vertically above the outlet ends. If desired or necessary, the material 55 may be conveyed by shaping the blades 29 and 39 as screws so that the material is conveyed as in a screw conveyor in addition to or instead of conveying the material by gravity.

Moisture is applied to material 55 in the annular space 43 as it is conveyed from the inlet ends of the cylinders toward the outlet ends. Preferably, the moisture is applied through nozzles 53 on conduits 47 pumped by a pump 51 from a source of moisture 49 into the annular space 43. By manipulating the characteristics of the moisture delivery equipment, such as by selecting different sizes and characteristics for nozzles 53 and by placing conduits 47 at different locations throughout the annular space 43, different amounts of moisture are preferably applied to the material 55 at different locations in the annular space. The moisture is preferably applied to the material 55 in the annular space 43 as atomized droplets, preferably at ambient or normal room temperature, although, for some applications it may be desirable to introduce moisture in the form of a stream or sheet or cascade of moisture or in the form of steam.

The first cylinder 23 and the second cylinder 33 are preferably rotated by a common drive 45, in the same direction of rotation, and at the same rotational speed. As shown in FIG. 3, however, the first cylinder 23 may be rotated by a first drive 45*a* and the second cylinder 33 may be rotated by a second drive 45*b*. Again, the first cylinder 23 and the second cylinder 33 are preferably rotated in the same rotational direction, and at the same rotational speed. In the embodiment of FIGS. 1 and 2 and in the embodiment of FIG. 3, however, it will be appreciated that, by appropriate gearing or arrangement of the drives, the first cylinder 23 and the second cylinder 33 may be rotated in different rotational directions and/or at different rotational speeds.

While this invention has been illustrated and described in accordance with a preferred embodiment, it is recognized that variations and changes may be made therein without departing from the invention as set forth in the claims.

What is claimed is:

1. A humidifying cylinder, comprising:

a first rotatable cylinder having an inlet end and an outlet end and a plurality of first blades extending substantially radially outwardly from an exterior surface of the first cylinder;

a second rotatable cylinder having an inlet end and an outlet end and a plurality of second blades extending substantially radially inwardly from an interior surface of the second cylinder, the second cylinder being substantially coaxial with the first cylinder and the first cylinder being disposed inside of the second cylinder such that the exterior surface of the first cylinder and the interior surface of the second cylinder define an annular space;

at least one drive for rotating the first cylinder and the second cylinder; and at least one conduit disposed in the annular space for introducing moisture into the annular space.

2. The humidifying cylinder as set forth in claim 1, wherein the at least one conduit includes openings for introducing moisture at different locations in the annular space.

3. The humidifying cylinder as set forth in claim 2, wherein the at least one conduit permits introduction of different amounts of moisture at the different locations in the annular space.

4. The humidifying cylinder as set forth in claim 1, wherein the at least one conduit includes nozzles for introducing moisture as atomized droplets.

5. The humidifying cylinder as set forth in claim 1, wherein the at least one drive includes a single motor arranged to drive both the first cylinder and the second cylinder.

6. The humidifying cylinder as set forth in claim 5, wherein the at least one drive is arranged to drive the first cylinder and the second cylinder in a same direction of rotation.

7. The humidifying cylinder as set forth in claim 1, wherein the at least one drive is arranged to drive the first cylinder and the second cylinder in a same direction of rotation.

8. The humidifying cylinder as set forth in claim 1, wherein the at least one drive includes a first drive for driving the first cylinder and a second drive for driving the second cylinder.

9. The humidifying cylinder as set forth in claim 8, wherein the at least one drive is arranged to drive the first cylinder and the second cylinder in a same direction of rotation.

10. The humidifying cylinder as set forth in claim 1, wherein the inlet end of the first cylinder and the inlet end of the second cylinder are disposed vertically above the outlet end of the first cylinder and the outlet end of the second cylinder, respectively.

11. The humidifying cylinder as set forth in claim 1, wherein the first cylinder, the first blades, the second cylinder, and the second blades are sized such that, when the first cylinder and the second cylinder are rotated, material falls from second blades onto the first cylinder and then falls from first blades onto the second cylinder.

* * * * *